United States Patent [19]

Akune et al.

[11] 4,316,878

[45] Feb. 23, 1982

[54] METHOD FOR THE COMBUSTIVE TREATMENT OF WASTE FLUIDS CONTAINING NITROGEN COMPOUNDS

[75] Inventors: Mikio Akune, Yokosuka; Yoshiaki Kinoshita, Hino, both of Japan

[73] Assignee: Nittetu Chemical Engineering Ltd., Tokyo, Japan

[21] Appl. No.: 117,507

[22] Filed: Feb. 1, 1980

[30] Foreign Application Priority Data

Feb. 8, 1979 [JP] Japan ..... 54-12787

[51] Int. Cl.[3] ..... B01D 53/34

[52] U.S. Cl. ..... 423/235; 422/183; 110/238

[58] Field of Search ..... 110/238, 345, 203; 423/235, 351; 422/182, 183

[56] References Cited

U.S. PATENT DOCUMENTS

| | | | |
|---|---|---|---|
| 3,838,193 | 9/1974 | Kajitani et al. | 423/235 X |
| 4,080,425 | 3/1978 | Tanaka et al. | 423/351 X |
| 4,115,515 | 9/1978 | Tenner et al. | 423/235 |
| 4,154,567 | 5/1979 | Dahmen | 422/182 |
| 4,216,060 | 8/1980 | Murata et al. | 423/235 X |

FOREIGN PATENT DOCUMENTS

| | | | |
|---|---|---|---|
| 2550635 | 5/1976 | Fed. Rep. of Germany | 423/235 |
| 52-6142 | 1/1977 | Japan | 110/203 |
| 1121602 | 7/1968 | United Kingdom . | |

*Primary Examiner*—G. O. Peters

*Attorney, Agent, or Firm*—Kenway & Jenney

[57] ABSTRACT

A waste fluid containing nitrogen compounds is combusted in an incinerator having cylindrical primary and secondary combustion chambers connected in series by a venturi throat member. The waste fluid is combusted in the primary combustion chamber at a temperature of at least 1200° C. while injecting air into the primary combustion chamber in a direction tangential to the inner periphery thereof so that the combustion gas forms a vortex pattern therein. The whirling combustion gas containing nitrogen oxides is caused to pass through the venturi throat into which a gas or liquid containing a compound having a nitrogen-hydrogen bond is injected for mixing with the combustion gas and the mixture is combusted in the secondary combustion chamber at a temperature of between 850° and 1150° C. The nitrogen oxides produced in the primary combustion chamber are reduced by reaction with the nitrogen-hydrogen bond-containing compound so that the exhaust gas from the secondary combustion chamber has a low content of nitrogen oxides.

13 Claims, 1 Drawing Figure

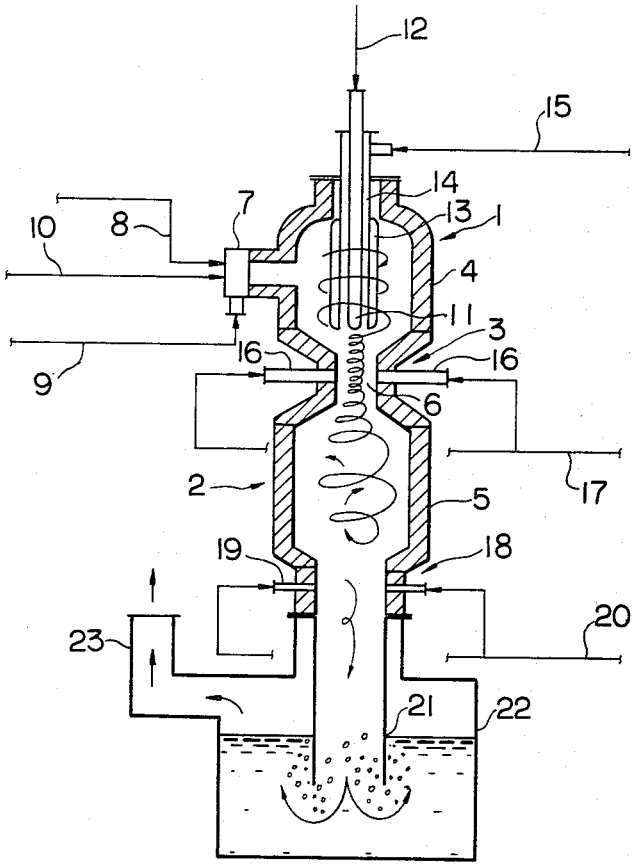
12
15
14
13
1
7
8
10
4
11
3
16
16
9
6
2
5
17
19
18
20
23
21
22

METHOD FOR THE COMBUSTIVE TREATMENT OF WASTE FLUIDS CONTAINING NITROGEN COMPOUNDS

BACKGROUND OF THE INVENTION

This invention relates to a method for the combustive treatment of a waste fluid, such as an exhaust gas or spent liquor, which contains compounds generating nitrogren oxides upon combustion in the presence of air.

Large amounts of nitrogen oxides, the $NO_x$, are produced when burning waste materials containing nitrogen compounds, causing a problem of environmental pollution. Especially, when the nitrogen compounds have no nitrogen-hydrogen bonds such as nitro, nitroso, nitrate, cyan, isocyanate and cyanate compounds, they are easily decomposed or oxidized within wide ranges of temperature and oxygen concentrations to generate nitrogen oxides. In view of preventing air pollution which has now become a big social problem, therefore, it is highly desirable to inhibit discharge of nitrogen oxides from combustion units.

In the combustive treatment of waste materials, the use of a compact combustion furnace is desirable to avoid a requirement for large floor space and to save construction costs. In compact furnaces, however, in order to ensure complete combustion of combustible materials in the waste material and to enable high-load combustion, it is necessary to effect the combustion at a temperature of at least 1200° C. Such high temperature combustion necessarily invites production of nitrogen oxides in increased amounts.

SUMMARY OF THE INVENTION

The present invention provides a method for combusting a waste fluid containing nitrogen compounds in an incinerator having cylindrical, coaxially aligned primary and secondary combustion chambers connected in series by a connecting member having a throat portion, and a burner located in the primary combustion chamber and adapted for burning combustible materials contained in the waste fluid. The steps involved in the method include feeding the waste fluid and, if necessary, an auxiliary fuel to the primary combustion chamber to combust same at a temperature of at least 1200° C. while injecting air thereinto at a velocity and in a direction tangential to the inner periphery of the primary combustion chamber to establish a vortex therein. The thus formed whirling combustion gas containing large amounts of nitrogen oxides is then caused to pass at a high velocity through the throat portion into which a fluid containing compounds having nitrogen-hydrogen bonds, such as amines and ammonia, is injected for uniform mixing therewith. The resulting mixture is then introduced into the secondary combustion chamber for combustion at a temperature of between 850° and 1150° C. while maintaining the oxygen concentration at the exit of the secondary combustion chamber not greater than 5% by volume. Under such combustion conditions in the secondary chamber, the generation of nitrogen oxides is substantially prevented and, moreover, the nitrogen oxides produced in the combustion in the primary chamber and introduced into the secondary chamber are converted into molecular nitrogen by reduction with the compounds containing nitrogen-hydrogen bonds.

When the nitrogen compounds contained in the waste fluid to be treated have nitrogen-hydrogen bonds, a part of the waste fluid can be used as at least a part of the fluid which is injected into the throat portion. Further, all of such a waste fluid can be fed to the throat portion for combustion in the secondary combustion chamber. In this case, it is necessary to feed an auxiliary fuel to the burner of the primary combustion chamber in order to effect the combustion of the waste fluid in the secondary chamber.

When the nitrogen compounds in the waste fluid are of the type which generate nitrogen oxides upon combustion at a temperature of 850° to 1150° C. in an atmosphere of a residual oxygen concentration of not greater than 5% by volume, the waste fluid should be combusted in the primary combustion chamber.

The waste fluid and the fluid to be injected into the throat portion can contain organic materials as well. If the content of the organic materials is high, cooling water is fed to the throat portion so as to maintain the combustion temperature in the secondary combustion chamber within the range of between 850° and 1150° C. The cooling water too can contain organic materials.

It is, therefore, an object of the present invention to provide a method by which waste gases or liquids containing nitrogen compounds can be combusted with incinerator in a high efficiency while minimizing the discharge of nitrogen oxides therefrom.

Another object of this invention is to provide a method for the combustive treatment of such a waste fluid using a small size incinerator.

BRIEF DESCRIPTION OF THE DRAWING

Other objects, features and advantages of the present invention will become apparent from the detailed description of the preferred embodiments of the invention which follows, when considered in light of the accompanying drawing, in which the sole FIGURE is a cross-sectional, elevational view diagrammatically showing the incinerator system used for carrying out the method of this invention.

DETAILED DESCRIPTION OF THE PREFERRED EMBODIMENTS OF THE INVENTION

Referring to the FIGURE, the incinerator system has a cylindrical primary combustion chamber 1 which is connected in series to and coaxially aligned, preferably vertically, with a cylindrical secondary combustion chamber 2 by means of a joining member 3. The primary and secondary combustion chambers include first and second housings 4 and 5, respectively, each of which is lined throughout with a suitable refractory material (not shown). The joining member 3 is also lined with a suitable refractory and is shaped so as to define within it a throat portion 6. Thus, the joining member 3 is of a venturi or an orifice type and widens toward both its upper and lower ends.

A burner 7 is located in the primary combustion chamber 1, to which a waste fluid, air and, if necessary, an auxiliary fuel are supplied through lines 8, 9 and 10, respectively, for combustion in the chamber 1.

A fluid injection nozzle 11 extends through the center of the end wall of the first housing 4 and is so configured as to cause the fluid introduced from a line 12 to be injected toward the center of the throat portion 6. A mantle 13 formed of a refractory material surrounds the nozzle 11 for protecting it from the impingement of the high temperature combustion gas. A space 14 defined between the nozzle 11 and the mantle 13 serves as a passage for air introduced from a line 15 for thermal protection of the nozzle.

Means, preferably two or more angularly equally spaced nozzles 16 are provided at the periphery of the throat portion 6, from which cooling water fed from a line 17 is introduced into the throat portion 6.

The present invention will be described in more detail hereinbelow in connection with an embodiment in which a waste liquid containing compounds which tend to generate nitrogen oxides upon combustion at a temperature not higher than 1150° C. is treated using the above-described incinerator system.

The waste liquid is fed through the line 8 to the burner 7 where it is mixed with air supplied from the line 9 for injection into the primary combustion chamber 1. The combustion in the primary combustion chamber 1 is effected at a temperature of at least 1200° C., preferably between 1250° and 1500° C. When the waste liquid has a low calorific value and cannot provide the necessary combustion temperature, a liquid or gas auxiliary fuel such as L.P.G. (liquified petroleum gas) around a fuel oil, e.g. kerosene and Bunker C, is fed through the line 10 in an amount sufficient to effect the combustion in the primary combustion chamber 1 at a temperature of at least 1200° C. As described hereinafter, the auxiliary fuel is also fed to the primary combustion chamber through the burner 7 when a desirable combustion temperature in the second combustion chamber 2 is not obtained.

In order to assure complete combustion of combustible materials in the waste liquid, it is important to establish a vortex in the primary combustion chamber 1. To achieve this purpose, the air and, preferably the waste liquid and auxiliary fuel too, are injected at a velocity and in a direction tangential to the inner periphery of the primary combustion chamber 1.

By the combustion treatment of the waste liquid in the primary combustion chamber 1, a large amount of nitrogen oxides is produced. The nitrogen oxides-containing combustion gas is caused to whirl in a vortex pattern along the inner wall of the first housing 4 and the flow velocity thereof becomes higher as it flows towards the throat portion 6.

A fluid containing a compound having a nitrogen-hydrogen bond, such as an amine, ammonia or an ammonium salt, is injected through the nozzle 11 into the throat portion 6 so that the fluid is mixed with and dispersed into the high velocity vigorously whirling combustion gas to form a homogeneous mixture. Thereafter, the whirling mixture is suddenly spread at the diverging portion, i.e. the outlet of the throat portion 6, causing a pressure drop in the center portion thereof. As a result, the gases in the vicinity of the outlet of the secondary combustion chamber 2 flow back toward the throat portion 6 and, hence, local variations in temperature and concentration of reactants of the combustion gas are prevented, thus establishing a substantially uniform reaction system in the secondary combustion chamber 2. Thus, the formation of the vortex in the primary combustion chamber 1 is also important in this respect. The high temperature gas produced in the primary combustion chamber 1 serves as an igniter to effect the combustion in the secondary combustion chamber 2.

In the secondary combustion chamber 2, the burning out of combustible materials contained in the mixture is effected together by the reduction of nitrogen oxides with the compounds having nitrogen-hydrogen bonds. Thus, the fluid containing compounds having nitrogen-hydrogen bonds is introduced into the throat portion 6 in an amount such that the content of nitrogen oxides in the waste combustion gas exhausted from the secondary combustion chamber 2 is reduced to a predetermined value. The feed amount of the fluid is preferably such that the molar ratio of the nitrogen-hydrogen bonds to the oxygen atoms of the nitrogen oxides produced in the primary combustion chamber 1 is at least 1.5, preferably at least 2.0.

The fluid to be injected through the nozzle 11 into the throat portion 6 can contain organic materials. Since organic materials such as hydrocarbons may act as reducing agents for nitrogen oxides, their presence in the fluid is preferable. When a waste liquid or gas containing compounds having nitrogen-hydrogen bonds is available, the use thereof as the fluid to be injected into the throat portion 6 is desirable.

In order both to sufficiently effect the reduction of nitrogen oxides and to completely burn out combustible materials in the secondary combustion chamber, it is necessary to maintain the temperature within the secondary combustion chamber in the range of between 850° and 1150 ° C. When the fluid to be injected into the throat portion 6 has a low calorific value and the combustion thereof cannot attain the above temperature, an auxiliary fuel is fed to the primary combustion chamber so as to obtain the necessary temperature in the second combustion chamber 2. On the other hand, when the fluid to be injected into the throat portion 6 has so high a calorific value or when the combustion temperature in the primary combustion chamber 1 is so high that the temperature within the secondary combustion chamber exceeds 1150° C., cooling water is supplied from the nozzles 16 into the throat portion 6 to control the temperature within the secondary combustion chamber 2 to within the range of between 850° and 1150° C.

The oxygen content in the combustion system in the secondary combustion chamber 2 is another important factor for minimizing the content of nitrogen oxides in the gas exhausted from the secondary combustion chamber 2. Good results can be obtained by maintaining the residual oxygen content in the exhaust gas from the secondary combustion chamber 2 at not greater than 5% by volume, preferably at not greater than 3% by volume. Since too low an oxygen content tends to lead to an increase in concentration of carbon monoxide and hydrogen gas and to the formation of soot in the exhaust gas, it is preferred that the residual oxygen content be not lower than 0.5% by volume. The control of the residual oxygen content can be done by adjustment of the feed amount of air supplied from the line 9 and 15.

When the waste liquid to be treated contains compounds having nitrogen-hydrogen bonds and does not yield nitrogen oxides upon combustion under the conditions adopted in the secondary combustion chamber 2, a portion thereof can be subjected to the combustive treatment in the primary combustion chamber 1 while the other portion may be used as at least a part of the fluid injected from the nozzle 11. Alternatively, the waste liquid may be treated only in the second combustion by introducing it through the nozzle 11 while introducing an auxiliary fuel through the line 10 in an amount sufficient to provide necessary temperatures in the primary and secondary combustion chambers. The nitrogen oxides produced by the combustion of the auxiliary fuel are converted into nitrogen gas by reduction with the waste liquid in the secondary combustion chamber 2.

The exhaust gas from the secondary combustion chamber 2 can be introduced into a tertiary combustion chamber 18 for further combustion treatment thereof. This is desirable especially when the waste combustion gas from the secondary combustion chamber 2 contains carbon monoxide. The combustion in the tertiary combustion chamber 18 is effected at a temperature not exceeding 1000° C. In the particular embodiment shown in the FIGURE, the tertiary combustion chamber is provided contiguous to the second combustion chamber 2 and has an air injection nozzle means 19 located downstream the outlet of the secondary combustion chamber 2.

The waste combustion gas from the secondary combustion chamber 2 or tertiary combustion chamber 18 may be introduced through a pipe 21 into a quench tank 22 where it is brought into contact with quenching water, thereby to cool the waste combustion gas and to collect ashes contained therein. The vapor laden gas emitted from the tank 22 is discharged to the air or introduced into a heat exchanger, mist separator or the like through a duct 23. In an alternative, the waste combustion gas from the chamber 2 or 18 may be introduced into a heat exchanger such as waste heat boiler for recovering the heat thereof. In this case, when the waste combustion gas contains molten ashes, it is introduced into the boiler after cooling to a temperature below the melting temperature of the ashes. Such ashes are generally produced when the fluid injected from the nozzle 11 or the cooling water supplied from the nozzles 16 contains alkali metal salts and other metal salts.

The following example will further illustrate the present invention.

EXAMPLE

A waste liquid containing 70 wt % of organic materials (17 wt % of aniline and 53 wt % of other organic compounds) and 30 wt % of water was treated at a rate of 500 Kg/hour in accordance with the method of this invention using the incinerator system shown in the FIGURE. The inner diameters of the primary combustion chamber 1, the throat portion 6 and the secondary combustion chamber 2 were 900, 300 and 1300 mm, respectively. The lengths of the chambers 1 and 2 were 1300 and 3500 mm, respectively. The calorific value of the organic materials was 6000 Kcal/Kg.

250 Kg/hour of the waste liquid and 50 Kg/hour of kerosene were continously fed through the lines 8 and 10 to the burner 7 which opened into the primary combustion chamber 1 tangentially to the inner periphery thereof. The waste liquid and the kerosene were injected from the burner 7 using 2700 $Nm^3$/hour of air, supplied thereto through the line 9, into the primary combustion chamber 1 for complete combustion at a temperature of 1350° C. and a residual oxygen concentration of about 9% by volume. A vortex was established in the chamber 1. The content of nitrogen oxides in the combustion gas at the outlet portion of the primary combustion chamber 1 was 1200 ppm.

Another 250 Kg/hour of the waste liquid was continuously fed through the line 12 to the nozzle 11 for injection toward the throat portion 6. Air was continuously fed to the space 14 between the nozzle 11 and the mantle 13 at a rate of 450 $Nm^3$/hour for thermal protection of the nozzle 11.

To the throat portion 6 was further injected waste water containing 6 wt % of organic materials (calorific value 4000 Kcal/Kg), 4 wt % of sodium chloride and 90 wt % of water at a rate of 1200 Kg/hour from three nozzles 16.

Thus, the whirling combustion gas produced in the primary combustion chamber 1 and containing nitrogen oxides was vigorously mixed with the waste liquid and the waste water during its passage through the throat portion 6 and the mixture was admitted into the secondary combustion chamber 2 and burnt there at a temperature of 1000° C. with a residual oxygen concentration of 2% by volume. As a result, the concentration of nitrogen oxides in the gas exhausted from the secondary combustion chamber 2 was reduced to 80 ppm.

Since the exhaust combustion gas from the chamber 2 was found to contain a trace amount of carbon monoxide, the gas was introduced into the tertiary combustion chamber 18 for further treatment. Air was fed through the line 20 and four nozzles 19 to the tertiary combustion chamber 18 at a rate of 300 $Nm^3$/hour. The combustion in the chamber 18 was effected at a temperature of 900° C. No increase in nitrogen oxides concentration in the exhaust gas from the chamber 18 was found. The exhaust gas was then introduced into the quenching vessel 22 through the tube 21 for cooling same and for recovering sodium chloride contained therein. The combustion gas was cooled to about 90° C. upon contact with the liquid in the vessel 22 and was then discharged into the air.

What is claimed is:

1. A method for treating a waste fluid containing a nitrogen compound by combustion in an incinerator having cylindrical, coaxially aligned primary and secondary combustion chambers connected in series with each other by a joining member provided with a throat portion which widens toward both combustion chambers, and a burner located in said primary combustion chamber, said method comprising:

(a) feeding the waste fluid through said burner to said primary combustion chamber to burn combustible materials in the waste fluid at a temperature of at least 1200° C. while injecting air into said primary combustion chamber at a velocity and in a direction tangential to the inner periphery thereof to establish a vortex therewithin, whereby a whirling combustion gas containing nitrogen oxides is formed;

(b) causing said combustion gas in said primary combustion chamber to pass through said throat portion while injecting thereinto a fluid containing a compound having a nitrogen-hydrogen bond for mixing with said combustion gas;

(c) introducing said mixture from said throat into said secondary combustion chamber in a diverging pattern thereby producing a pressure drop in the center of said secondary combustion chamber whereby gases in the vicinity of the outlet of the secondary combustion chamber will reverse flow back toward said throat to minimize local variations in temperature and concentration;

(d) burning said combustible materials in said mixture in said secondary combustible chamber at a temperature of between 850° and 1150° C;

(e) controlling the amount of air injected into said incinerator so that the residual oxygen content in the resulting waste combustion gas discharged from said secondary combustion chamber does not exceed 5% by volume; and (f) discharging said waste combustion gas from said secondary combustion chamber.

2. A method as claimed in claim 1, wherein an auxiliary fuel is fed to said primary combustion chamber for combustion with the waste fluid to maintain the temperature of the combustion gas in said primary combustion chamber at least 1200° C.

3. A method as claimed in claim 1 or 2, wherein the temperature of the combustion gas in said primary combustion chamber is in the range of between 1250° and 1500° C.

4. A method as claimed in claim 1, wherein an auxiliary fuel is fed to said primary combustion chamber for combustion with the waste fluid in an amount so that the temperature of the combustion gas in said secondary combustion chamber is within the range of between 850° and 1150° C.

5. A method as claimed in claim 1, wherein cooling water is fed to said throat portion in an amount so that the combustion gas in said secondary combustion chamber is within the range of between 850° and 1150° C.

6. A method as claimed in claim 1, wherein the residual oxygen content is maintained within the range of between 0.5 and 3 vol %.

7. A method as claimed in claim 1, wherein said nitrogen compound in the waste fluid is a compound having a nitrogen-hydrogen bond and a portion of said waste fluid is used as at least a part of said fluid injected into said throat portion.

8. A method as claimed in claim 1, wherein the air is injected into said primary combustion chamber together with the waste fluid.

9. A method as claimed in claim 2 or 4, wherein the air and the auxiliary fuel are injected into said primary combustion chamber together with the waste fluid.

10. A method as claimed in claim 1, further comprising introducing said waste combustion gas into a tertiary combustion chamber to which air is fed for further combustion treatment of said waste combustion gas at a temperature not higher than 1000° C.

11. A method as claimed in claim 10, further comprising discharging the waste combustion gas from said tertiary combustion chamber and introducing same into a quenching vessel for cooling same and for collecting ashes contained therein by direct contact with a quenching liquid contained in said vessel.

12. A method for treating a waste fluid containing a compound having a nitrogen-hydrogen bond by combustion in an incinerator having cylindrical, coaxially aligned primary and secondary combustion chambers connected in series with each other by a joining member provided with a throat portion which widens toward both combustion chambers, and a burner located in said primary combustion chamber, said method comprising:

(a) feeding an auxiliary fuel through said burner to said primary combustion chamber for burning at a temperature of at least 1200° C. while injecting air into said primary combustion chamber at a velocity and in a direction tangential to the inner periphery thereof to establish a vortex therewithin, whereby a whirling combustion gas is formed;

(b) causing the combustion gas in said primary combustion chamber to pass through said throat while injecting into said throat portion the waste fluid for mixing with the combustion gas;

(c) introducing said mixture from said throat into said secondary combustion chamber in a diverging pattern thereby producing a pressure drop in the center of said secondary combustion chamber whereby gases in the vicinity of the outlet of the secondary combustion chamber will reverse flow back toward said throat to minimize local variations in temperature and concentration;

(d) burning said combustible materials in said mixture in said secondary combustible chamber at a temperature of between 850° and 1150° C.;

(e) controlling the amount of air injected into incinerator so that the residual oxygen content in the resulting waste combustion gas discharged from said secondary combustion chamber does not exceed 5% by volume, and (f) discharging said waste combustion gas from the secondary combustion chamber.

13. A method as claimed in claim 12, wherein the air is injected into said primary combustion chamber together with the auxiliary fuel.

* * * * *

UNITED STATES PATENT AND TRADEMARK OFFICE

CERTIFICATE OF CORRECTION

PATENT NO. : 4,316,878

DATED : February 23, 1982

INVENTOR(S) : AKUNE et al.

It is certified that error appears in the above—identified patent and that said Letters Patent is hereby corrected as shown below:

Column 3, line 23, "around" should read ---or---.

Claim 1, line 32 (column 6, line 64) "combustible" should read ---combustion---.

Claim 12, line 30 (column 8, line 33) "combustible" should read ---combustion---.

Signed and Sealed this

*Twentieth* Day of *July 1982*

[SEAL]

*Attest:*

GERALD J. MOSSINGHOFF

*Attesting Officer*

*Commissioner of Patents and Trademarks*